US008291650B2

(12) United States Patent
Vreeland

(10) Patent No.: US 8,291,650 B2
(45) Date of Patent: Oct. 23, 2012

(54) PYLON ATTACHMENT DEVICE AND FLOORING SYSTEM UTILIZING SAME

(76) Inventor: Paul Vreeland, Gresham, OR (US)

( * ) Notice: Subject to any disclaimer, the term of this patent is extended or adjusted under 35 U.S.C. 154(b) by 317 days.

(21) Appl. No.: 12/631,593

(22) Filed: Dec. 4, 2009

(65) Prior Publication Data

US 2011/0131894 A1 Jun. 9, 2011

(51) Int. Cl.
*E04B 1/98* (2006.01)

(52) U.S. Cl. ..... 52/167.2; 52/126.5; 248/562; 248/636; 267/289

(58) Field of Classification Search ..... 52/167.1–167.8, 52/126.1, 126.5, 126.6; 248/562, 565, 636; 267/250, 289, 291
See application file for complete search history.

(56) References Cited

U.S. PATENT DOCUMENTS 3,794,277 A 2/1974 Smedley et al.
3,906,689 A * 9/1975 Nakayama ..... 52/167.6
4,496,130 A * 1/1985 Toyama ..... 248/585
4,527,365 A * 7/1985 Yoshizawa et al. ..... 52/167.8
4,587,773 A 5/1986 Valencia
4,599,834 A * 7/1986 Fujimoto et al. ..... 52/167.8
5,363,610 A 11/1994 Thomas et al.
6,457,285 B1 10/2002 Valencia
6,948,284 B2 9/2005 Chiang
2004/0221520 A1 11/2004 Chiang

* cited by examiner

*Primary Examiner* — William Gilbert
(74) *Attorney, Agent, or Firm* — Dale J. Ream

(57) ABSTRACT

A pylon attachment device for coupling a pylon to a floor joist includes a bearing plate for fixed attachment to the floor joist. The pylon attachment device includes a plurality of biasing members, each having a first end operatively coupled to the pylon and a second end operatively coupled to the bearing plate to allow the bearing plate to move relative to the pylon in a direction generally perpendicular to an imaginary center axis of the pylon and then return to a predetermined position. The attachment device includes a cap lowerly adjacent the bearing plate. A shear pin extends from the cap to the bearing plate to maintain the bearing plate at the predetermined position until a predetermined amount of force shears the shear pin and allows the bearing plate to move relative to the pylon in a direction generally perpendicular to the imaginary center axis of the pylon.

6 Claims, 5 Drawing Sheets

PYLON ATTACHMENT DEVICE AND FLOORING SYSTEM UTILIZING SAME

BACKGROUND OF THE INVENTION

This invention relates generally to a flooring system and, more particularly, to a flooring system utilizing a pylon attachment device. The flooring system according to this invention is useful for stabilizing a building structure during an earthquake.

An earthquake is a sudden movement of the Earth's crust that causes seismic waves to be transmitted away from the central point of a release of energy. As tectonic plates within the Earth's surface move against or over one another, an enormous amount of energy is released. This release of energy may cause shaking or displacement of the ground, the amount of movement ranging from an almost imperceptible level to levels causing significant damage to buildings and infrastructure such as roadways, utility lines, and the like.

Many larger construction projects as well as construction in regions having deep or soft soil use a pylon system for a building's foundation. Various devices and support systems have been proposed in the art for stabilizing buildings with pylons against the damaging effects of earthquakes. Pylons or other support pole constructions may be reinforced with metal bars to resist swaying forces. Although assumably effective for their intended purposes, the existing devices do not provide a solution for massive side to side oscillations.

Therefore, it would be desirable to have a flooring system utilizing a pylon attachment device having a slip surface situated between a metal plate and the pylon to allow for lateral shearing oscillations. Further, it would be desirable to have a flooring system utilizing a pylon attachment device having a sheer pin that provides stability to a predetermined level but then allows lateral slippage without pylon failure. In addition, it would be desirable to have a flooring system utilizing a pylon attachment device that allows pylon movement while biasing the pylon toward its center position.

SUMMARY OF THE INVENTION

A pylon attachment device for coupling a pylon to a floor joist includes a bearing plate for fixed attachment to the floor joist. The pylon attachment device includes a plurality of biasing members, each biasing member having a first end operatively coupled to the pylon and a second end operatively coupled to the bearing plate to allow the bearing plate to move relative to the pylon in a direction generally perpendicular to an imaginary center axis of the pylon and then return to a preset position.

The attachment device includes a cap lowerly adjacent the bearing plate. A shear pin extends from the cap to the bearing plate to maintain the bearing plate at the preset position until a predetermined amount of force shears the shear pin and allows the bearing plate to move relative to the pylon in a direction generally perpendicular to the imaginary center axis of the pylon.

Therefore, a general object of this invention is to provide a pylon attachment device for coupling a pylon to a floor joist.

Another object of this invention is to provide a pylon attachment device, as aforesaid, that allows a pylon to move in a lateral direction and then to return to its predetermined position.

Still another object of this invention is to provide a pylon attachment device, as aforesaid, in which a shear pin maintains a bearing plate at a predetermined position until a predetermined amount of force shears the shear pin and allows the bearing plate to move laterally relative to the pylon.

Yet another object of this invention is to provide a pylon attachment device, as aforesaid, that may utilize a compression spring to absorb vertical forces upon a pylon.

A further object of this invention is to provide a pylon attachment device, as aforesaid, that is easy to install.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
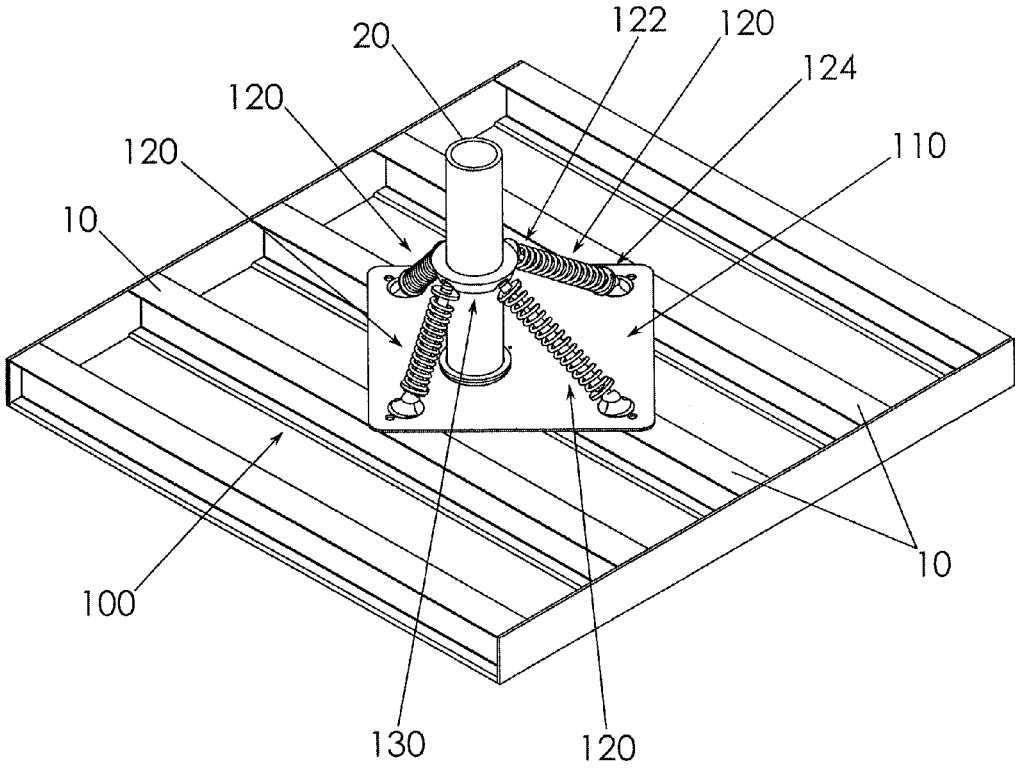
FIG. 1 is a bottom perspective view of a pylon attachment device according to a preferred embodiment of the present invention.

Pylon attachment devices and flooring systems according to the present invention will now be described in detail with reference to FIGS. 1 through 5 of the accompanying drawings. More particularly, a pylon attachment device 100 according to one embodiment includes a bearing plate 110 and a plurality of biasing members 120.

The bearing plate 110 may be generally planar, as shown throughout the drawings, and is configured to be fixedly attached to, and support, at least one floor joist 10. In some embodiments, as specifically shown in FIGS. 1, 4*a*, and 4*b*, the bearing plate 110 may be configured to support three floor joists 10. It should be understood that more or fewer floor joists 10 may be supported by the bearing plate 110, however.

As shown in FIG. 1, each biasing member 120 has first and second ends 122, 124. Each first end 122 is operatively coupled to a pylon 20 when in use. The first ends 122 may be directly coupled to the pylon 20, or a support ring 130 (FIG. 1) may be fixedly coupled to the pylon 20, and the first ends 122 may be coupled to the support ring 130. The second ends 124 are operatively coupled to the bearing plate 110 to allow the bearing plate 110 to move relative to the pylon 20 in a direction generally perpendicular to an imaginary center axis of the pylon 20 and then return to a preset (or "balanced" or "centered") position. The second ends 124 may be directly coupled to the bearing plate 110, or clips 135 (FIG. 2) may be fixedly coupled to the bearing plate 110, and the second ends 124 may be coupled to the clips 135.

It may be desirable for the biasing members 120 to be generally equi-angularly positioned about the imaginary center axis of the pylon 20. For example, if three biasing members 120 are included, it may be desirable for the biasing members 120 to be spaced generally 120° from one another; if four biasing members 120 are included, it may be desirable for the biasing members 120 to be spaced generally 90° from one another; if six biasing members 120 are included, it may be desirable for the biasing members 120 to be spaced generally 60° from one another, et cetera.

Figure 2:
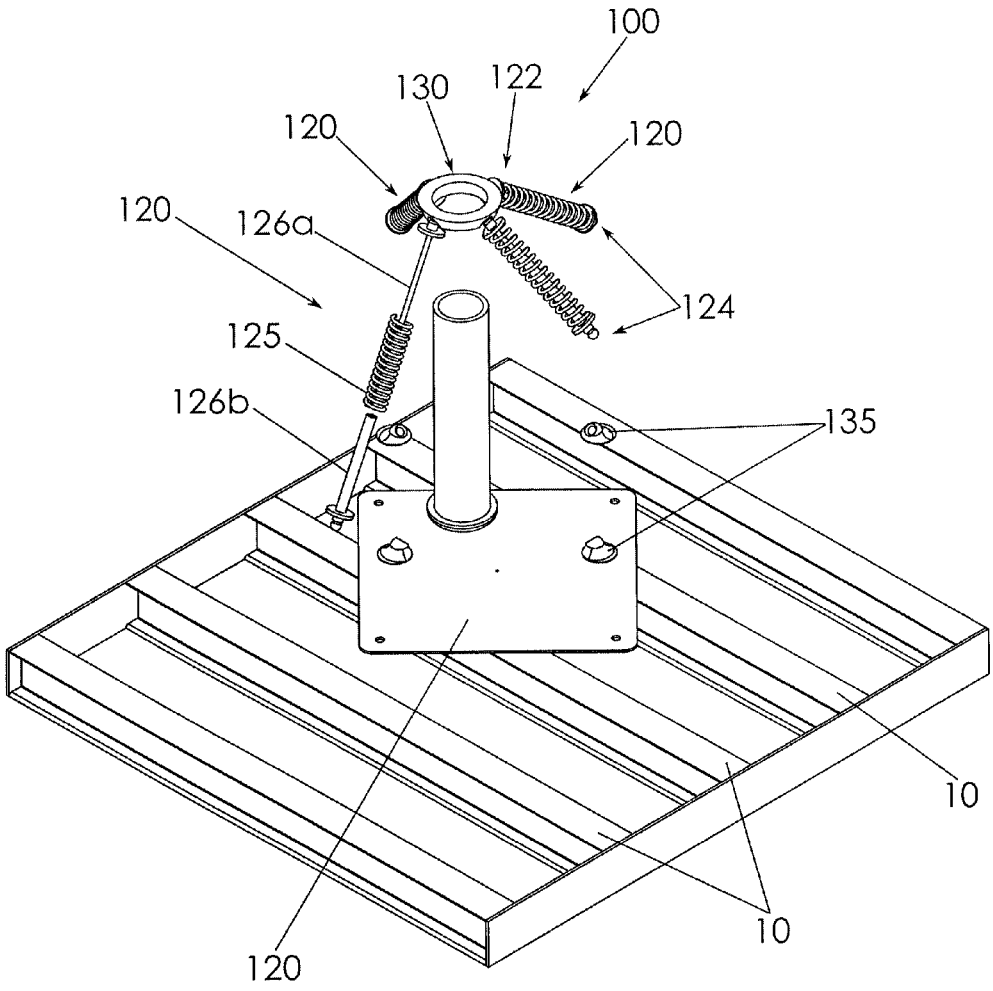
FIG. 2 is an exploded view of the pylon attachment device as in FIG. 1.

Each biasing member 120 may include a spring 125 and/or a dampener 126 (e.g., a hydraulic dampener or a pneumatic dampener having a piston 126*a* and a complementary cylinder 126*b*, shown in FIG. 2). Especially if dampener 126 is included, the first end 122 may be pivotably coupled to the support ring 130 (or the pylon 20) and the second end 124 may be pivotably coupled to a respective clip 135 (or the bearing plate 110).

Figure 4A:
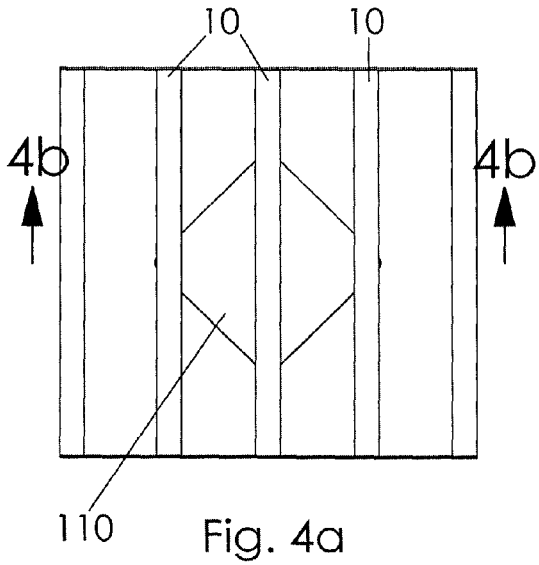
FIG. 4*a* is a top view of the pylon attachment device as in FIG. 1.
Figure 4C:
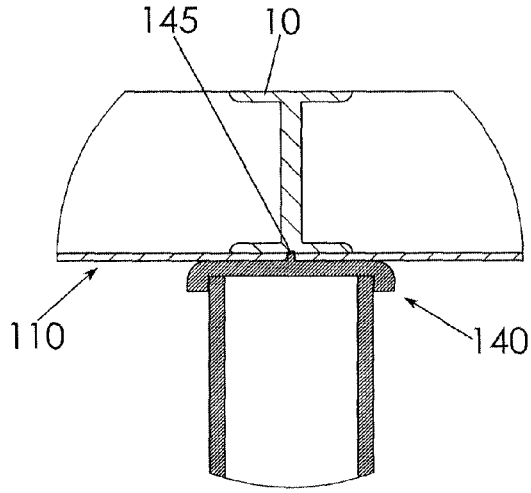
FIG. 4*c* is an isolated view on an enlarged scale taken from FIG. 4*b*.
Figure 4B:
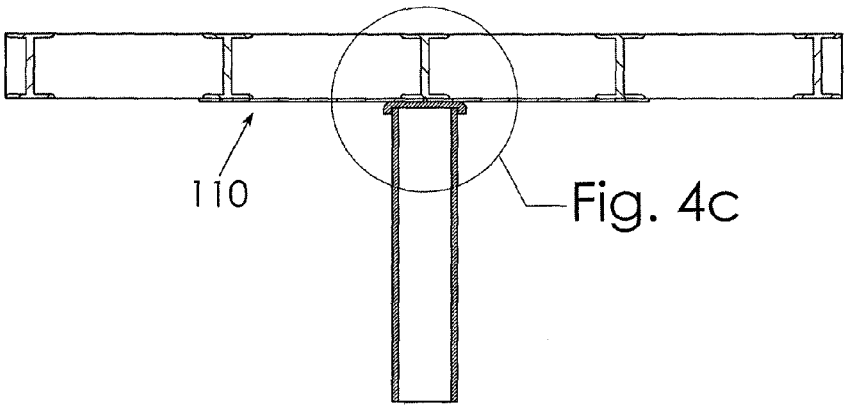
FIG. 4*b* is a sectional view taken along line 4*c*-4*c* of FIG. 4*a;*

As best shown in FIG. 4*c*, a cap 140 may be lowerly adjacent the bearing plate 110. A shear pin 145 (FIG. 4*c*) may extend from the cap 140 to the bearing plate 110 to maintain the bearing plate 110 at the preset position until a predetermined amount of force shears the shear pin 145, allowing the bearing plate 110 to move relative to the pylon 20 in a direction generally perpendicular to the imaginary center axis of the pylon 20. The cap 140 may be directly coupled to the pylon 20, or may be coupled to a telescoping member 150.

Figure 5:
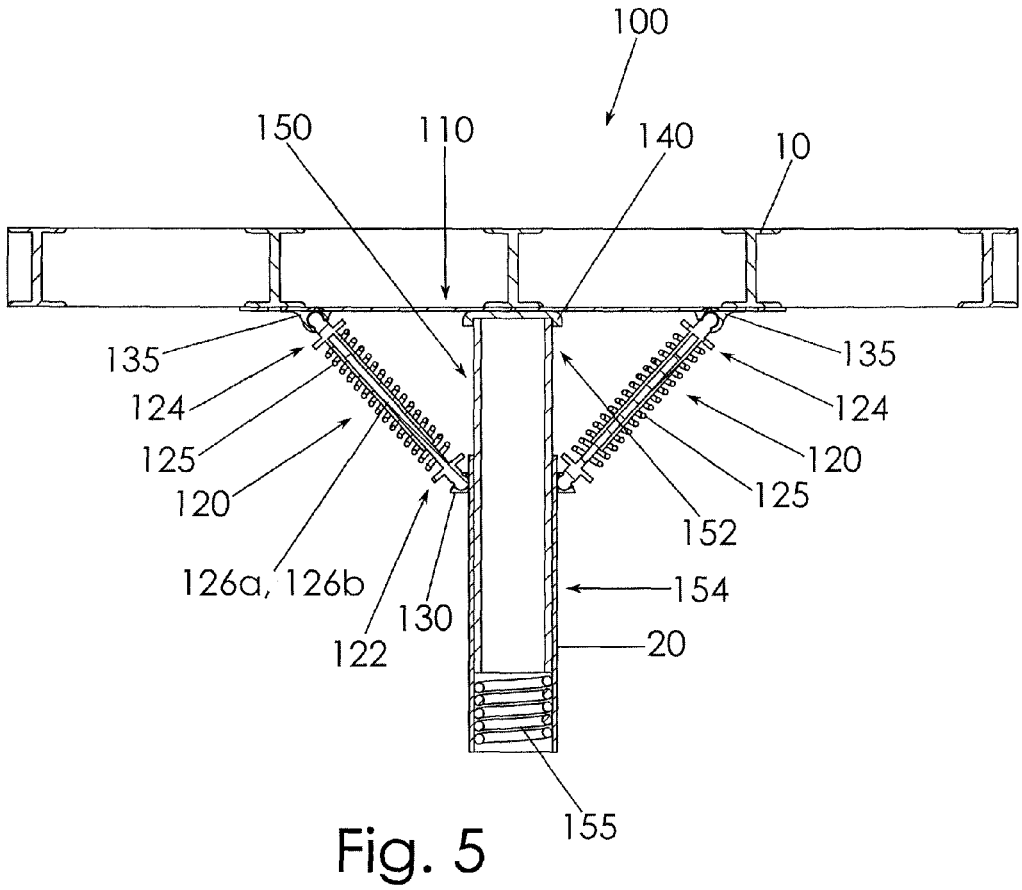
FIG. 5 is a sectional view as in FIG. 4*b* according to another embodiment of the present invention.

As shown in FIG. 5, the telescoping member 150 may be telescopically coupled to the pylon 20 such that the telescoping member 150 is movable along the imaginary center axis of the pylon 20 (i.e., generally vertically). An upper end 152 of the telescoping member 150 may be coupled to the cap 140 or otherwise support the bearing plate 110, and a lower end 154 of the telescoping member 150 is shown to be received inside the pylon 20. Means (e.g., a spring 155 operatively coupled to the telescoping member 150) may be included to bias the telescoping member 150 to a preset telescoping position relative to the pylon 20.

Figure 3A:
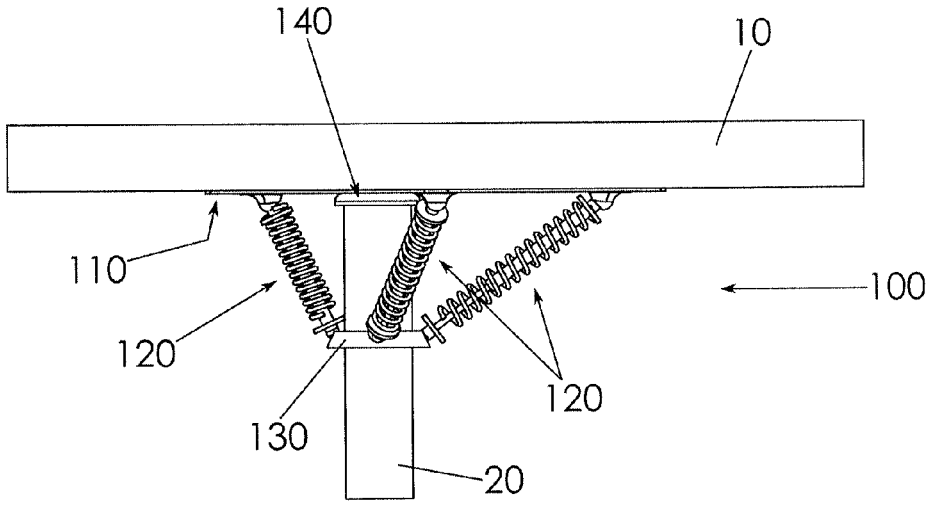
FIG. 3*a* is a side view of the pylon attachment device in one position.
Figure 3B:
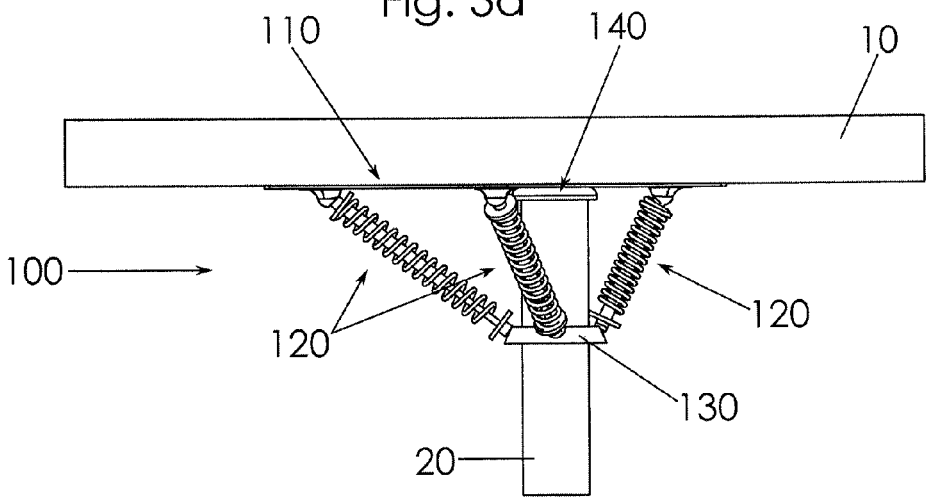
FIG. 3*b* is a side view of the pylon attachment device in another position.

In use, the bearing plate 110 is installed above the pylon 20, the biasing members 120 couple the bearing plate 110 to the pylon 20 (as described above), and the floor joists 10 are attached to the bearing plate 110. This arrangement is shown, for example, in FIG. 1. The shear pin 145 (FIG. 4*c*) may keep the bearing plate 110 stationary relative to the pylon 20 in the generally horizontal plane until a predetermined amount of force is applied, such as through an earthquake. Once the predetermined amount of force is applied, the pin 145 may be destroyed (i.e., sheared), and the bearing plate 110 may move in the horizontal plane relative to the pylon 20 (i.e., perpendicularly to the imaginary center axis of the pylon 20). The biasing members 120 may absorb force as the bearing plate 110 moves away from the preset position, and may then return the bearing plate 110 to the preset position. This may reduce or prevent damage to the floor joists 10 and accompanying building structure. FIGS. 3*a* and 3*b* show the bearing plate 110 moved in the horizontal plane relative to the pylon 20, and FIG. 1 shows the bearing plate 110 at the preset position.

If the telescoping member 150 is included, force (e.g., from an earthquake) may cause the telescoping member 150 to raise relative to the pylon 20 (i.e., to move along the imaginary center line of the pylon 20). The spring 155 may absorb force as the telescoping member 150 moves away from the preset telescoping position, and may then return the telescoping member 150 to the preset telescoping position.

To create a flooring system, a plurality of the pylon 20, floor joist 10, attachment device 100 arrangements set forth above may be used, such that a larger floor area is allowed to move in the manner described above for one pylon 20, floor joist 10, attachment device 100 arrangement.

It is understood that while certain forms of this invention have been illustrated and described, it is not limited thereto except insofar as such limitations are included in the following claims and allowable functional equivalents thereof.

The invention claimed is:

1. A pylon attachment device for coupling a pylon to a floor joist, said attachment device comprising:

a bearing plate for fixed attachment to said floor joist;

a plurality of biasing members, each biasing member having a first end operatively coupled to said pylon and a second end operatively coupled to said bearing plate to allow said bearing plate to move relative to said pylon in a direction generally perpendicular to an imaginary center axis of said pylon and then return to a preset position;

wherein said plurality of biasing members are equi-angularly positioned about said imaginary center axis of said pylon;

wherein at each said biasing member is a dampened biasing member that includes at least one item selected from the group consisting of a hydraulic dampener and a pneumatic dampener;

a cap lowerly adjacent said bearing plate;

a shear pin extending from said cap to said bearing plate to maintain said bearing plate at said preset position until a predetermined amount of force shears said shear pin and allows said bearing plate to move relative to said pylon in a direction generally perpendicular to said imaginary center axis of said pylon;

a support ring fixedly coupled to said pylon, and wherein said first end of each said dampened biasing member is pivotably coupled to said support ring;

a telescoping member telescopically coupled to said pylon and being movable along said imaginary center axis of said pylon, said telescoping member having an upper end coupled to said cap; and means for biasing said telescoping member to a preset position relative to said pylon.

2. The attachment device of claim 1, wherein at least one said biasing member includes a spring.

3. The attachment device of claim 1, further comprising a plurality of clips coupled to said bearing plate, and wherein said second end of each said dampened biasing member is pivotably coupled to a respective clip.

4. The attachment device of claim 3, wherein said cap is coupled to said pylon.

5. The attachment device of claim 1, wherein said means for biasing said telescoping member includes a spring operatively coupled to said telescoping member.

6. The attachment device of claim 5, wherein said telescoping member is received inside said pylon.

* * * * *